US005584633A

United States Patent [19]

Scharer

[11] Patent Number: 5,584,633

[45] Date of Patent: Dec. 17, 1996

[54] BINDER ELEMENT CONVEYING MECHANISM

[75] Inventor: Roger Scharer, Des Plaines, Ill.

[73] Assignee: General Binding Corporation, Northbrook, Ill.

[21] Appl. No.: 241,173

[22] Filed: May 10, 1994

[51] Int. Cl.[6] ..... B42B 9/00

[52] U.S. Cl. ..... 412/40; 412/1

[58] Field of Search ..... 412/1, 6, 9, 39, 412/40, 42

[56] References Cited

U.S. PATENT DOCUMENTS

| | | |
|---|---|---|
| 1,429,511 | 9/1922 | Lamb . |
| 3,027,047 | 3/1962 | Johnson . |
| 3,249,256 | 5/1966 | Stern et al. . |
| 3,327,089 | 6/1967 | Napoli . |
| 3,443,683 | 5/1969 | Felty, Jr. et al. . |
| 3,475,775 | 11/1969 | Staats . |
| 3,544,411 | 12/1970 | Staats . |
| 3,583,557 | 6/1971 | Staats . |
| 3,761,983 | 10/1973 | Staats . |
| 3,911,646 | 10/1975 | Larkin et al. . |
| 3,980,006 | 9/1976 | Welch . |
| 4,091,987 | 5/1978 | Cone . |
| 4,194,646 | 3/1980 | Oglander et al. . |
| 4,320,547 | 3/1982 | Stolle et al. . |
| 4,607,761 | 8/1986 | Wright . |
| 4,705,167 | 11/1987 | Nakamura . |
| 4,790,475 | 12/1988 | Griffin . |
| 4,805,771 | 2/1989 | Hein . |
| 5,071,030 | 12/1991 | Marcusen . |
| 5,125,508 | 6/1992 | Yamamoto . |

FOREIGN PATENT DOCUMENTS

| | | | |
|---|---|---|---|
| 3821904 | 2/1990 | Germany | 412/42 |
| 266991 | 10/1990 | Japan | 412/42 |
| 2096540 | 10/1982 | United Kingdom | 412/42 |

*Primary Examiner*—Willmon Fridie, Jr.
*Attorney, Agent, or Firm*—Hill, Steadman & Simpson

[57] ABSTRACT

An apparatus and method for successively delivering ring carrier elements to a paper loading station for producing bound booklets. The apparatus provides a carrier having ring elements adhesively attached thereto in spaced apart fashion, the carrier drawn to a ring loading station where individual elements are deposited onto a comb retainer whereat a ring spreader can open the rings for loading of paper thereon. The carrier can be fashioned as a fan-folded supply or can be a wound supply, having the elements adhesively attached thereto, or threaded thereon.

23 Claims, 1 Drawing Sheet

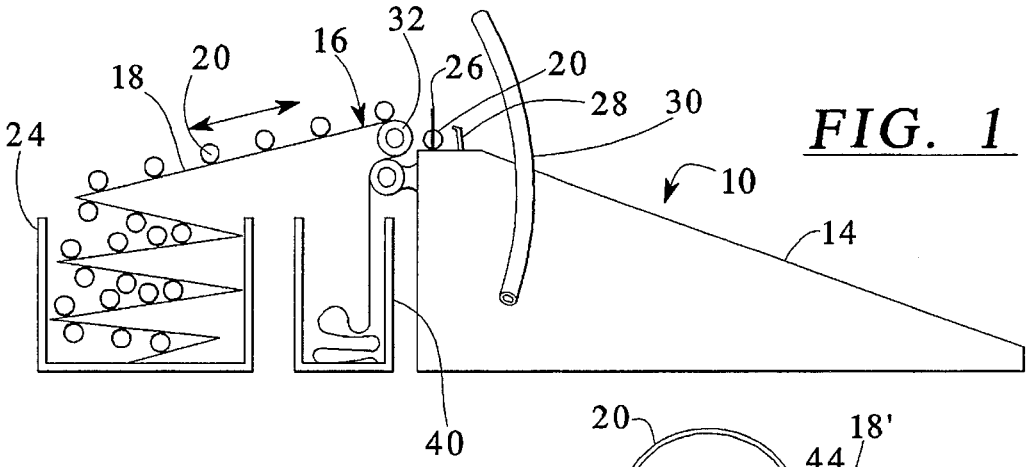
FIG. 1
FIG. 2
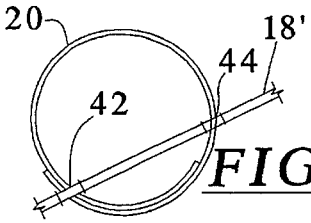
FIG. 2A
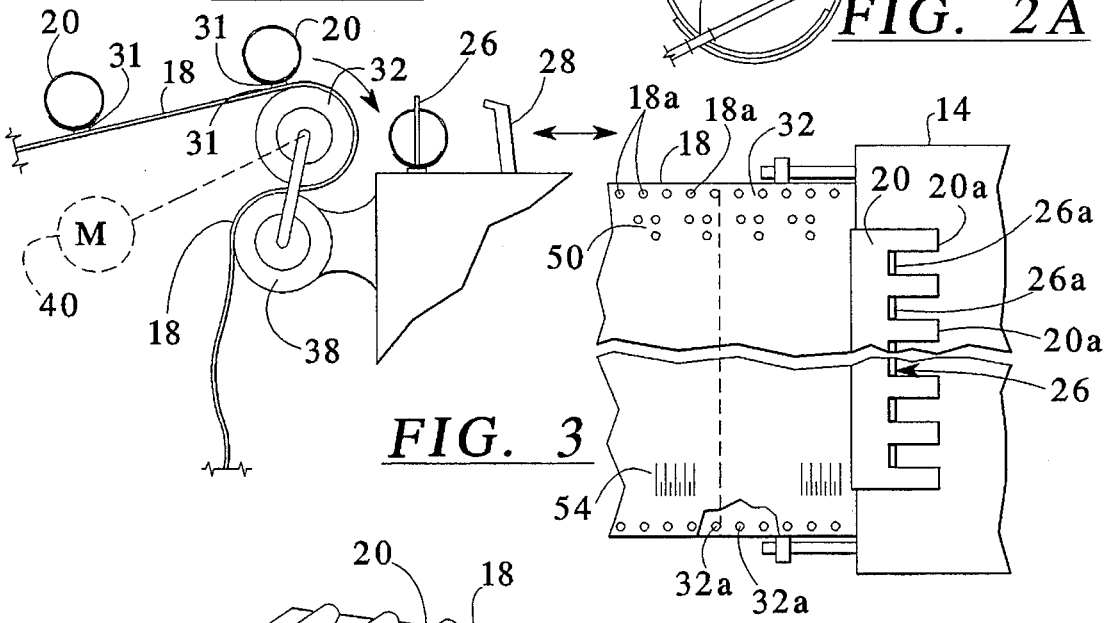
FIG. 3
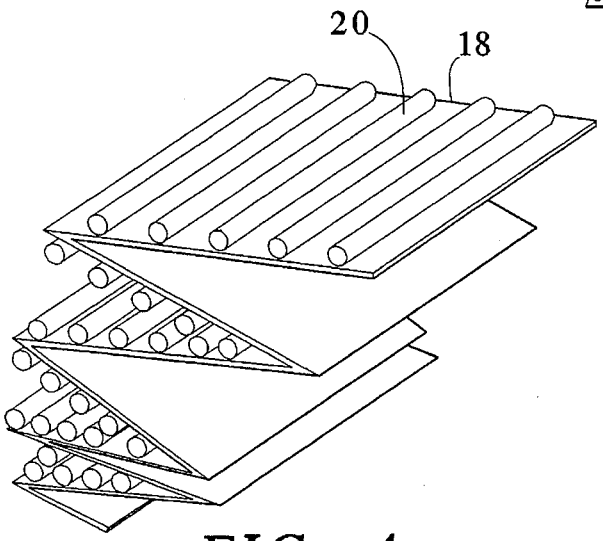
FIG. 4
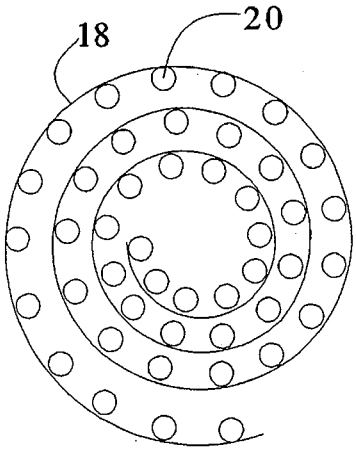
FIG. 5

BINDER ELEMENT CONVEYING MECHANISM

BACKGROUND OF THE INVENTION

The present invention relates to a method and apparatus for transporting binding elements to a binding station for combination with a stack of pages to be bound thereby in the production of booklets and the like. Such binding elements are usually plastic having a spine portion with transversely extending curled rings which are uncurled during loading of the stack of pages and which rebound to bind the stack of pages thereon.

In the binding of booklets involving a plurality of sheets perforated along one edge, and a plastic binding element having a spine portion with transversely extending curled rings, the binding element is supported on a comb shaped binding support of an apparatus with the rings extending between the teeth of the support. The rings are uncurled by finger members of the apparatus to enable the insertion of the perforations of the sheets onto the rings. The rings are then allowed to re-curl into a closed position. Two examples of an apparatus which accomplish this are U.S. Pat. Nos. 2,603,800 and 2,603,801.

Due to the problem of transporting a binding element to the desired orientation on the support with the curled rings extending between the teeth of the support to be engaged by fingers of the opening device, it has been proposed to releasably secure the binding elements on tape such as adhesive tape for transporting the elements to the support where they are peeled from the tape and positioned on the support. Such devices are disclosed in U.S. Pat. Nos. 3,475,775 and 3,761,983. However, such devices require accurate positioning of the parallel tapes onto the plurality of binders and also experience difficulty in tangling and storage because the tapes are susceptible to twisting and misalignment of the bindings.

SUMMARY OF THE INVENTION

It is an object of the present invention to provide an effective, easily manufactured assembly for successively feeding binder elements to a page loading station. It is also an object of the present invention to provide an assembly for such loading which is easily stored in a fan-fold manner for shipping and handling.

The object is inventively achieved in that a planar paper feed track is employed having the binding elements glued successfully thereon by a releasable adhesive for feeding the binding elements to a paper loading station. The planar feed track can be a fan-folded paper feed having the binding elements secured thereon by small regions of pressure sensitive adhesive. The paper feed track can be fan-folded similar to storage of computer print-out paper. The wide carrier provides stability and orientation and the ability to store larger quantities of oriented binding elements for later use without tangling.

The tractor feed medium can be provided with tractor advancing holes which allows precise placement and spacing of binding elements.

In an alternate embodiment, the binding elements can be connected to the tractor medium by fashioning the tractor medium with a plurality of holes which would correspond to the fingers of the binding element, such that the binding element can be threaded onto the tractor medium for transportation and removed at the paper loading station.

For control, the fan-folded paper can be provided with code holes which are "read" by the paper loading station. The code holes can correspond to each different size binding element (diameter and/or width). Alternatively, a bar code can be displayed on the paper carrier for this purpose.

BRIEF DESCRIPTION OF THE DRAWINGS

FIG. 1 is an elevational view of an apparatus of the present invention;

FIG. 2 is an enlarged elevational view of the apparatus shown in FIG. 1;

FIG. 2A is a partial elevational view of an alternate embodiment of the apparatus of FIG. 2;

FIG. 3 is a partial plan view of the apparatus shown in FIG. 2;

FIG. 4 is a perspective view of a carrier system of the present invention; and FIG. 5 is an alternate arrangement for storing the carrier system shown in FIG. 4.

DETAILED DESCRIPTION OF THE PREFERRED EMBODIMENTS

FIG. 1 illustrates an apparatus 10 of the present invention. The apparatus 10 provides a paper loading station 14 receiving a carrier feed 16 having a flexible feed belt such as a paper track 18 upon which is mounted a plurality of spaced apart binding elements 20. The paper feed 18 is fan-folded within a supply bin 24 in a fashion commonly known for dispensing computer paper. The apparatus 14 provides a comb-like retainer 26 upon which individual elements 20 are threaded and opened by movement of a plurality of finger members 28 as is known. An example of such a comb and finger arrangement is disclosed in U.S. Pat. Nos. 3,761,983, 3,475,775, 3,583,557 and 3,544,411, herein incorporated by reference. A lever 30 is shown for activating the finger members 28, although automated mechanism can also be provided.

As an alternate to the paper loading station 14, an automatic binding device can be utilized, fed by the carrier feed of the present invention. Such an automatic binding device is disclosed in U.S. Ser. No. 08/240,257, filed May 10, 1994, and incorporated herein by reference.

FIG. 2 illustrates the finger members 28 which are arranged and configured to spread the individual curled rings 20*a* of the element 20 in order for a stack of pages to be threaded down thereon to bind a booklet or the like. The elements 20 are attached to the track 18 by portions of pressure sensitive releasable adhesive 31, at, for example, two places along a length of each element 20. The adhesive can also be applied continuously along two stripes along a length of the paper. By being attached to the paper 18 at two points along a length of the element, the paper, in effect, helps to stretch and flatten bowed elements. Storage volume is reduced because fan-folding the paper 18 with the elements 20 within the bin 24 also helps flatten bowed elements. The carrier 16 is driven by a tractor feed roller 32 which delivers the individual elements 20 onto the comb-like retainer 26. The retainer halts further movement of the element 20 so that further movement of the track 18 separates the element 20 therefrom. An idle roller 38 is in close engagement with the tractor feed roller 32 and rotates therewith. The paper track 18 is threaded between the tractor feed roller 32 and the idle roller 38 and is thus driven therebetween and into a receptacle 40 for recycling or disposal. The tractor feed roller 32 is driven by a motor 40 shown schematically.

FIG. 2A illustrates an alternate embodiment of the invention wherein in lieu of the adhesive 31 the track is perforated in two rows of holes 42, 44, to accept the curled rings 20*a* threaded thereon.

FIG. 3 illustrates the comb-like retainer 26 having individual tines 26*a* and the element 20 having individual rings 20*a* threaded onto the comb-like retainer 26. The finger members 28 not shown are arranged to engage each ring member 20*a* and spread the ring member 20*a* to an open orientation for receiving paper.

FIG. 3 illustrates the paper 18 can have a series of tractor feed holes 18*a* for precise and timed delivery of the paper 18 having elements 20 applied thereon to the apparatus 14. For clarity, only one element 20 is shown located on the retainer 26 and further elements are not shown on the paper 18. The tractor feed roller 32 has protuberances or cleats for engaging the holes 18*a*. Although a tractor feed hole arrangement is advantageous, the tractor feed holes are not required and a frictional engagement only between the paper 18 and the rollers can be provided.

FIG. 3 also illustrates binder element code holes 50 which communicate information to the paper loading station 14 concerning the size (diameter and/or width) of the binder element 20 being fed thereto or any other useful information concerning the binder elements such as color, quantity, etc. Alternately, a bar code 54 can be displayed on the paper 18 to serve the same purpose.

FIGS. 4 and 5 illustrate alternate methods of storing quantities of elements 20 on paper 18 either by fan-folding the paper such as shown in FIG. 4, or by rolling the paper shown in FIG. 5.

Although the present invention has been described with reference to a specific embodiment, those of skill in the art will recognize that changes may be made thereto without departing from the scope and spirit of the invention as set forth in the appended claims.

I claim as my invention:

1. An apparatus for successively loading ring binding elements with paper, the ring binding elements having an elongate spine portion connecting a plurality of flexible curled rings having free ends, comprising:

a ring element retainer for holding stationary said spine portion during uncurling of said rings;

a means for uncurling the rings of the ring binder element for loading paper thereon;

a flexible feed belt having a plurality of spaced apart ring elements secured thereto spaced along a length thereof and arranged across a width of the feed belt, said feed belt having an overall width at least as great as a longitudinal dimension of said elements; and a means for removing successive elements from said belt onto said retainer.

2. The apparatus according to claim 1, wherein said means for removing comprises a feed roller for transporting said belt, said feed roller arranged adjacent said retainer, and said retainer stopping said element during further progression of said belt to remove the element from the belt.

3. An apparatus for successively loading ring binding elements with paper, the ring binding elements having an elongate spine portion connecting a plurality of flexible curled rings having free ends, comprising:

ring element retainer for holding stationary said spine portion during uncurling of said rings;

a means for uncurling the rings of the ring binder element for loading paper thereon;

a flexible feed belt having a plurality of spaced apart ring elements secured thereto, said feed belt having a width at least as great as said elements;

a means for removing successive elements from said belt onto said retainer;

wherein said means for removing comprises a feed roller for transporting said belt, said feed roller arranged adjacent said retainer, and said retainer stopping said element during further progression of said belt to remove the element from the belt; and an idler roller pressed to said feed roller, wherein said belt is threaded between said feed roller and said idle roller.

4. An apparatus for successively loading ring binding elements with paper, the ring binding elements having an elongate spine portion connecting a plurality of flexible curled rings having free ends, comprising:

a ring element retainer for holding stationary said spine portion during uncurling of said rings;

a means for uncurling the rings of the ring binder element for loading paper thereon;

a flexible feed belt having a plurality of spaced apart ring elements secured thereto, said feed belt having a width at least as great as said elements; and a means for removing successive elements from said belt onto said retainer;

wherein said belt comprises a fan-folded supply upstream of said retainer.

5. The apparatus according to claim 1, wherein said belt comprises a rolled supply upstream of said retainer.

6. An apparatus for successively loading ring binding elements with paper, the ring binding elements having an elongate spine portion connecting a plurality of flexible curled rings having free ends, comprising:

a ring element retainer for holding stationary said spine portion during uncurling of said rings;

a means for uncurling the rings of the ring binder element for loading paper thereon;

a flexible feed belt having a plurality of spaced apart ring elements secured thereto, said feed belt having a width at least as great as said elements;

a means for removing successive elements from said belt onto said retainer;

wherein said means for removing comprises a feed roller for transporting said belt, said feed roller arranged adjacent said retainer, and said retainer stopping said element during further progression of said belt to remove the element from the belt; and wherein said belt comprises tractor feed holes along at least one edge and said feed roller comprises a rotating wheel having protuberances to interfit within said tractor feed holes for precise translation of said belt.

7. The apparatus according to claim 6, wherein said belt comprises tractor feed holes along both edges.

8. The apparatus according to claim 1 wherein said elements are secured to said belt by adhesive.

9. An apparatus for successively loading ring binding elements with paper, the ring binding elements having an elongate spine portion connecting a plurality of flexible curled rings having free ends, comprising:

a ring element retainer for holding stationary said spine portion during uncurling of said rings;

a means for uncurling the rings of the ring binder element for loading paper thereon;

a flexible feed belt having a plurality of spaced apart ring elements secured thereto, said feed belt having a width at least as great as said elements;

a means for removing successive elements from said belt onto said retainer; and wherein said belt comprises a series of hole pairs across a width thereof and said elements are secured thereto by threading of said rings into said hole pairs.

10. A feed apparatus for delivering successive ring binder elements to a downstream station, comprising:

a unitary belt having a plurality of binding elements secured thereto in spaced apart fashion along a length of said belt, said belt having a width substantially equal to a longitudinal dimension of said elements, said elements secured at at least two places along a length of said binding elements, said belt accumulated in a supply region and progressing outwardly therefrom;

a means for translating said belt; and a separating means for successfully removing individual elements from said belt at said downstream station.

11. A feed apparatus for delivering successive ring binder elements to a downstream station, comprising:

a unitary belt having a plurality of binding elements secured thereto in spaced apart fashion, at least at two places along a length of said binding elements, said belt accumulated in a supply region and progressing outwardly therefrom;

a means for translating said belt; and a separating means for successfully removing individual elements from said belt at said downstream station;

wherein said accumulation of said belt comprises a bin holding a fan-folded arrangement of said belt.

12. The arrangement according to claim 11, wherein said accumulation of said belt comprises a rolled supply of said belt.

13. The apparatus according to claim 10, wherein said means for translating comprises a feed roller and an idle roller pressed to said feed roller forming a nip, and said belt having a lead portion threaded therethrough for drawing said belt upon rotation of said feed roller and said idle roller therethrough; and wherein said elements are removed from said belt upstream of said nip formed by said feed roller and said idle roller.

14. The apparatus according to claim 10, wherein said belt further comprises a readable code applied thereto which is read by the downstream station.

15. The apparatus according to claim 14, wherein said code comprises punched holes corresponding to a size dimension of the ring binder element.

16. The apparatus according to claim 14, wherein said code comprises a bar code corresponding to a size dimension of the ring binder element.

17. A method of successively delivering individual binding elements to a paper load station, comprising the steps of:

providing a retainer at said paper load station for receiving an element for spreading and loading paper sheets thereon;

providing a single elongate web having individual spaced apart elements removably secured thereon at two places along a length of each of said elements, said web having a width substantially equivalent to said length of one of said elements;

providing said web is driven toward said retainer;

providing a means for separating said elements successively from said web at said retainer;

translating said web toward said retainer at a selected rate;

successively removing elements from said web and placing said elements on said retainer;

loading said element with paper sheets and removing said element and paper sheets together successively synchronized with the removal of said element from said web onto said retainer.

18. A method of successively delivering individual binding elements to a paper load station, comprising the steps of:

providing a retainer at said paper load station for receiving an element for spreading and loading paper sheets thereon;

providing a single elongate web having individual spaced apart elements removably secured thereon at two places along a length of each of said elements;

providing said web is driven toward said retainer;

providing a means for separating said elements successively from said web at said retainer;

translating said web toward said retainer at a selected rate;

successively removing elements from said web and placing said elements on said retainer;

loading said element with paper sheets and removing said element and paper sheets together successively synchronized with the removal of said element from said web onto said retainer; and providing said web with said elements attached in a supply bin, fan-folded for removal therefrom.

19. A feed apparatus for delivering successive ring binder elements to a downstream station, comprising:

a belt having a plurality of binding elements secured thereto in spaced apart fashion, at least at two places along a length of said binding elements, said belt accumulated in a supply region and progressing outwardly therefrom;

a means for translating said belt; and a separating means for successfully removing individual elements from said belt at said downstream station;

wherein said accumulation of said belt comprises a bin holding a fan-folded arrangement of said belt.

20. An apparatus for successively loading ring binding elements with paper, the ring binding elements having an elongate spine portion connecting a plurality of flexible curled rings having free ends, comprising:

a ring element retainer for holding stationary said spine portion during uncurling of said rings;

a means for uncurling the rings of the ring binder element for loading paper thereon;

a flexible feed belt having a plurality of spaced apart ring elements secured thereto;

a means for removing successive elements from said belt onto said retainer; and wherein said belt comprises a series of hole pairs across a width thereof and said elements are secured thereto by threading of said rings into said hole pairs.

21. The apparatus according to claim 1, wherein said flexible feed belt is fan folded upstream of said retainer.

22. The apparatus according to claim 10, wherein said belt is fan folded upstream of said separating means.

23. This method according to claim 17, wherein said step of providing a single elongate web is further defined in that said web is fan folded upstream of said retainer.

* * * * *